United States Patent [19]

Gannaway

[11] 4,273,519

[45] Jun. 16, 1981

[54] SPLIT CRANKCASE RADIAL AUTOMOTIVE COMPRESSOR

[75] Inventor: Edwin L. Gannaway, Adrian, Mich.

[73] Assignee: Tecumseh Products Company, Tecumseh, Mich.

[21] Appl. No.: 939,877

[22] Filed: Sep. 5, 1978

[51] Int. Cl.[3] ..... F16J 10/02; F04B 1/04

[52] U.S. Cl. ..... 417/273; 92/171

[58] Field of Search ..... 417/273; 92/169, 171

[56] References Cited

U.S. PATENT DOCUMENTS

| | | | |
|---|---|---|---|
| 1,820,883 | 8/1931 | Hueber | 417/273 |
| 2,319,718 | 5/1943 | Brooks | 417/273 |
| 3,246,581 | 4/1966 | Carr | 92/169 |
| 3,431,865 | 3/1969 | Cook et al. | 417/273 |
| 3,685,923 | 11/1970 | Hutchins | 417/273 |
| 3,838,942 | 10/1974 | Pokorny | 417/269 |
| 3,910,164 | 10/1975 | Swadner | 417/273 |
| 3,924,968 | 12/1975 | Gaines | 417/273 |
| 4,050,852 | 9/1977 | Brucken | 417/273 |

FOREIGN PATENT DOCUMENTS

| | | | |
|---|---|---|---|
| 1096750 | 1/1961 | Fed. Rep. of Germany | 417/273 |
| 2415884 | 10/1975 | Fed. Rep. of Germany | 417/273 |

*Primary Examiner*—William L. Freeh

*Attorney, Agent, or Firm*—Albert L. Jeffers; John F. Hoffman

[57] ABSTRACT

A scotch yoke radial compressor especially adapted for use in automotive airconditioners having a cast aluminum crankcase which is split along a plane axially passing through the center lines of the radially oriented cylinders. Each of the crankcase halves has a plurality of radially extending semicylindrical recesses which, when assembled, form the cylinders. Cylindrical cylinder liners are preassembled to the pistons and this assembly is then placed in one of the crankcase halves with the liners being received in their respective semicylindrical recesses. The second crankcase half is then secured to the first, again with the semicylindrical recesses overlying the cylinder liners. The distal ends of the liners are sealed by means of annular flanges which are clamped between the crankcase and the valve plate assemblies located at the ends of the cylinders.

13 Claims, 7 Drawing Figures

SPLIT CRANKCASE RADIAL AUTOMOTIVE COMPRESSOR

BACKGROUND OF THE INVENTION

The present invention relates to a radial compressor and in particular to a scotch yoke radial compressor adapted for use in an automotive air-conditioner.

Automotive air conditioning systems require small, lightweight compressors which can be conveniently mounted to the engine and driven by the same belt system that drives the fan, alternator and power steering pump. One compressor which has been found to meet these requirements is a radial compressor wherein a plurality of pistons are reciprocated within cylinders radially disposed about the crankshaft.

One problem with this type of compressor, however, is the difficulty of assembling the pistons to the crankshaft and crankcase. One prior art approach is to insert the pistons through the cylinders and then press fit them to the yoke assembly. A more satisfactory technique is disclosed in U.S. Pat. No. 3,910,164, which discloses a radial compressor wherein the crankcase is split, with each of the two halves including a plurality of semicylindrical cross recesses. The piston assembly is placed in one of the crankcase halves and then the other half is secured thereto. A relatively wide annular flexible Teflon seal compensates for small tolerance mismatch between the piston bore forming registering cross recesses. An obvious difficulty with this design is providing a good seal between the crankcase halves, which is necessary to prevent leakage. This problem is especially troublesome in the case of aluminum crankcases, which have surfaces that are porous in nature.

SUMMARY OF THE INVENTION

The problems and disadvantages of the prior art radial compressors are overcome by the present invention wherein the pistons are preassembled with stamped steel cylinder liners prior to assembly with the crankcase. The liners prevent leakage through the interface between the crankcase halves and provide the desired compatability for wear against the aluminum pistons.

Specifically, the present invention relates to a radial compressor of the type including a crankcase having a plurality of radially oriented cylinders therein, a crankshaft rotatably received in the crankcase and positioned at the center of the cylinders, and pistons connected to the crankshaft and received in the cylinders for reciprocating movement. The crankcase is of the split type comprised of two halves joined together at an interface axially intersecting the cylinders. The improvement comprises the provision of cylindrical liners in each of the cylinders providing a sliding surface for the respective piston and sealing the interface between the crankcase halves, and means for sealing one end of each of the liners.

The invention also contemplates a method for assembling the radial compressor wherein the two crankcase halves include semicylindrical recesses therein forming the cylinders when joined, said method comprising: providing a plurality of pistons, inserting each of the pistons into a respective cylindrical cylinder liner, inserting the pistons and liners into the respective semicylindrical recesses in one of the crankcase halves, placing the other crankcase half on the first crankcase half with the semicylindrical recesses therein overlying the cylinder liners, and securing the crankcase halves together.

The liners are contacted by the confronting surfaces of the recesses, and serve to align the recesses of the respective pairs in the tangential direction relative to the axis of the crankshaft.

It is an object of the present invention to provide a radial compressor of the split crankcase variety wherein the cracks in the cylinder walls at the interface between the two crankcase halves are sealed by means of steel cylinder liners within which the pistons reciprocate.

A further object of the present invention is to provide cooling for the rotating seal of such a compressor wherein a portion of the incoming refrigerant passes into the seal cavity through a passageway in the crankshaft.

A still further object of the present invention is to provide a radial compressor of the split crankcase variety wherein the crankcase is enclosed in a two-piece outer housing defining the suction and discharge chambers for the compressor.

Another object of the present invention is to provide a scotch yoke radial compressor of the split crankcase variety utilizing a drawn-cup needle bearing in the yoke slide, thereby eliminating the need for retainer plates and greatly facilitating assembly.

These and other objects of the present invention will become apparent from the detailed description taken together with the accompanying drawings.

and

Figure 7:
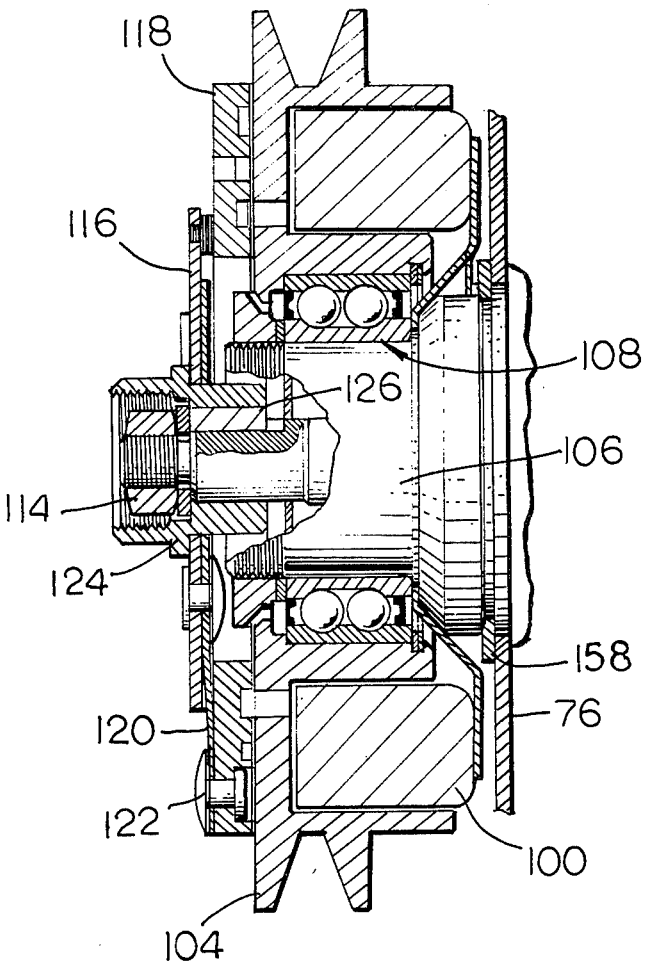

FIG. 7 is a sectional view of a modification.

DETAILED DESCRIPTION

Referring now to the drawings, the compressor according to the present invention comprises a crankcase 10 being formed of two halves 12 and 14 joined together at an interface 16 by means of screws 18, which pass through web portions 20. Each of the crankcase halves, which are preferably formed of cast aluminum, include four semicylindrical recesses 22 forming the cylinder walls. When the crankcase halves 12 and 14 are assembled, respective recesses 22 together form the cylinders 24. Web portions 20 are located between adjacent cylinders 24.

The compressor is of the scotch yoke radial type and includes a pair of integral double ended piston-yoke elements 26 and 28, which are preassembled to yoke slide 30 and crankshaft 32. Preassembled drawn cup needle bearing 34, which comprises a plurality of needles 36 contained within an annular cup 38 drawn around the needles 36, permits relative rotation between yoke slide 30 and the crankshaft eccentric 40. This type of bearing assembly permits easy assembling of the compressor, as opposed to loosely assembled needles which require retainer plates.

Figure 1:
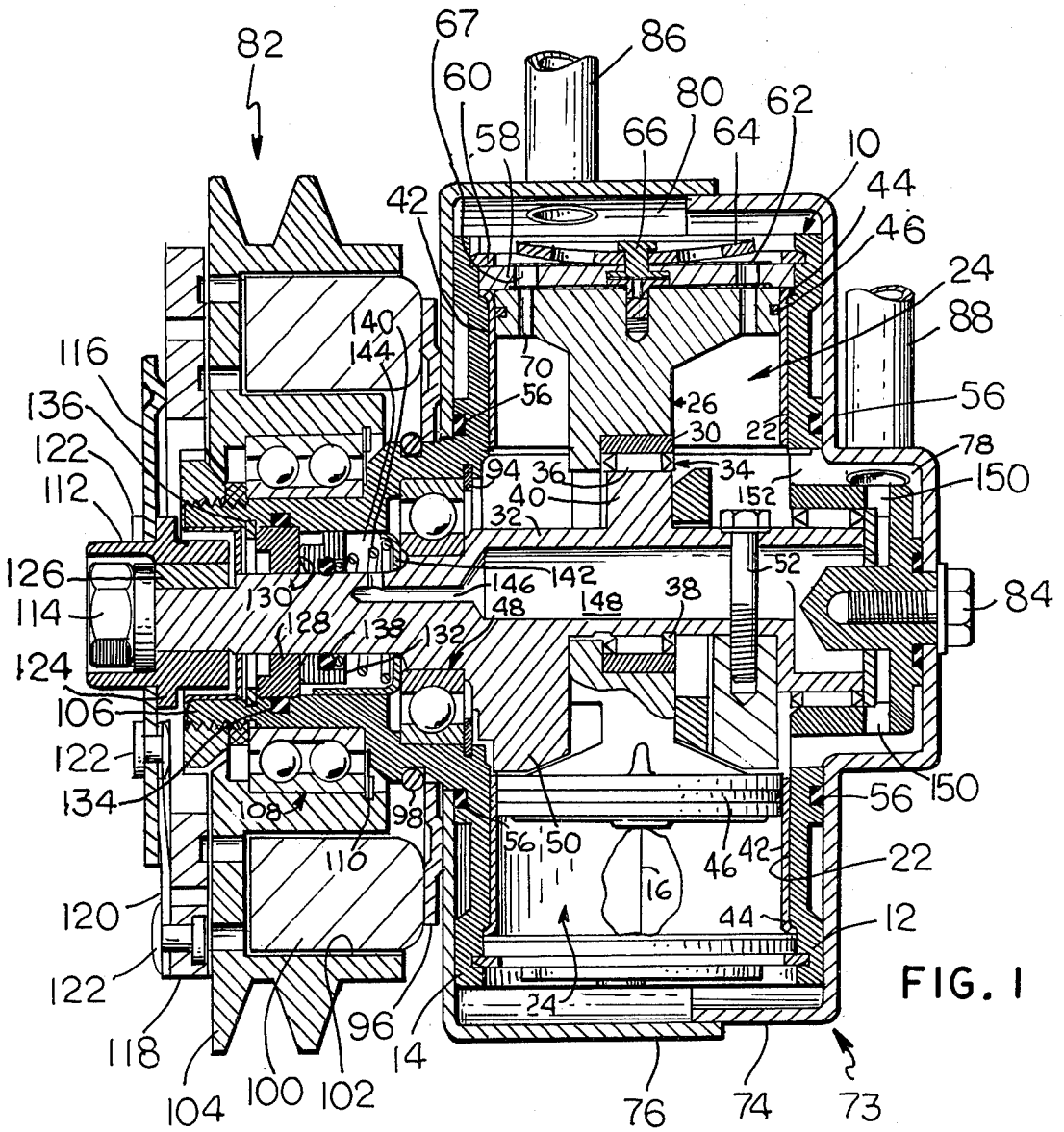
FIG. 1 is a sectional view of a scotch yoke radial compressor according to the present invention.

Pistons 26 are inserted within respective stamped steel cylinder liners 42, which are generally cylindrical in shape and include short flanges 44 on their distal ends. Pistons 26 are preassembled to liners 42 with their piston rings 46 in place and the entire assembly comprising crankshaft 32, piston-yoke elements 26, slide 30, bearing 34 and cylinder liners 42 are inserted in the left half 14 of crankcase 10, as viewed in FIG. 1, with crankshaft 32 being inserted through bearings 48 and liners 42 being received in recesses 22.

Counterweight 50 is secured to crankshaft 32 by means of screw 52. The other half 12 of crankcase 10 is then slipped over bearing 54, which is also of the drawn cup type, such that its semicylindrical recesses 22 are brought into register with liners 42. The two crankcase halves 12 and 14 are then secured together by means of screws 18. Seals 56 are then emplaced around crankcase 10.

The valve mechanism for the compressor comprises valve plates 58, which are forced tightly against the flanges 44 of cylinder liners 42 so as to clamp them against crankcase 10, by means of snap rings 60. Discharge leaf valve 62 is held against valve plate 58 by means of dish-shaped retainer 64, which is secured to valve plate 58 by rivet 66. On the piston power stroke, pressurized refrigerant is forced through openings 67 past valve 62.

Suction leaf valve 68 is held in place over suction openings 70 by screw 72, which is threadedly secured to piston 26.

A steel outer housing 73, formed of front and rear covers 74 and 76, serves to form the intake and outlet chambers 78 and 80, respectively, and minimizes leakage problems normally encountered with porous aluminum die cast surfaces. Cover 76 abuts against the clutch and drive mechanism 82 and cover 74 is secured to crankcase 10 by means of screw 84. Discharge tube 86 and suction tube 88 connect with chambers 80 and 78, respectively.

Figure 5:
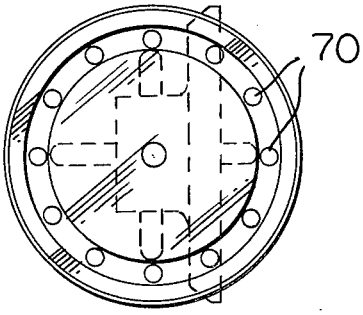
FIG. 5 is an end view of the piston-yoke elements.
Figure 4:
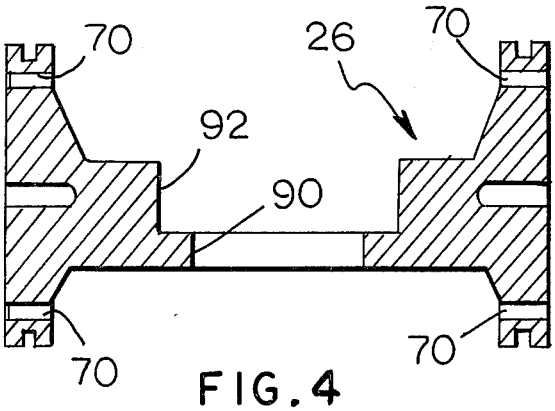
FIG. 4 is a sectional view of FIG. 3 taken along line 4—4 and viewed in the direction of the arrows.
Figure 2:
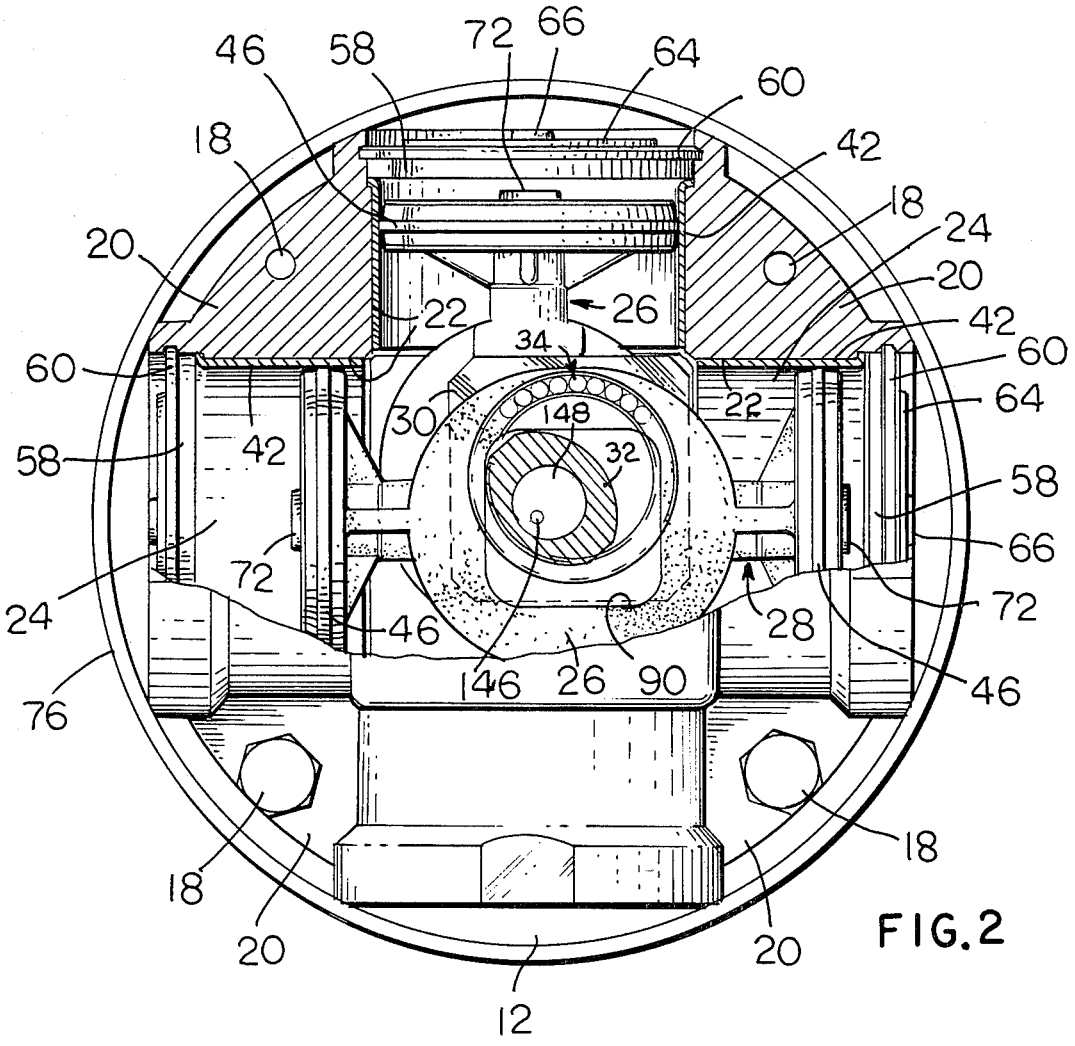
FIG. 2 is a partially sectioned end view of the compressor as viewed from the right side of FIG. 1.
Figure 3:
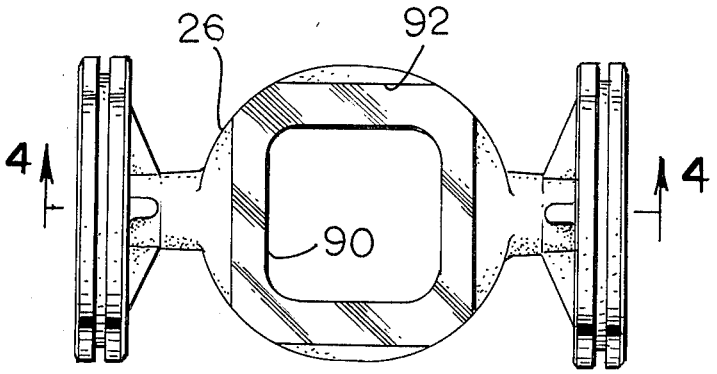
FIG. 3 is a plan view of one of the integral piston-yoke elements of the compressor.
Figure 6:
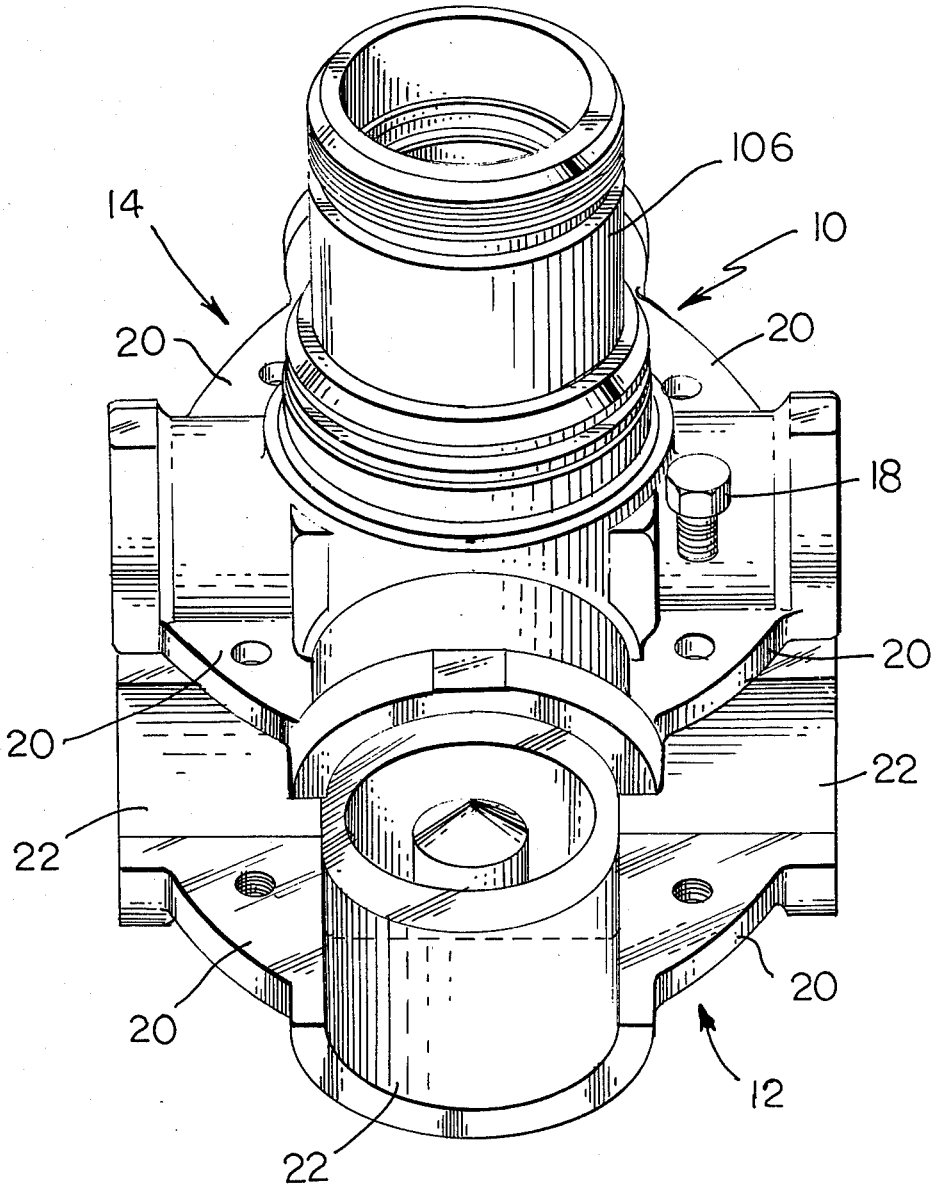
FIG. 6 is an exploded perspective view of the crankcase.

One of the piston-yoke elements 26 is illustrated in FIGS. 3, 4 and 5. It comprises a smaller, generally square opening 90 to accommodate crankshaft 32, and a larger generally square open recess 92 within which yoke slide 30 moves. Piston-yoke element is preferably made of cast aluminum, which provides the desired compatability with the steel cylinder liners 22 for improved wear.

Bearings 48 are retained by snap ring 94, and backing plate 96 is held in tight abutment with cover 76 by means of retaining ring 98, and also serves as the backing member for clutch coil 100. Coil 100 is received within an annular recess 102 in pulley 104, the latter being rotatably supported on the pedestal 106 of crankcase 10 by means of bearings 108, which are prevented from shifting by snap ring 110.

Hub 112 is connected to shaft 32 by means of nut 114, and hub plate 116 is connected to armature 118 through spring 120. Spring 120 is connected to plate 116 and armature 118 by rivets 122. When coil 100 is energized, armature 118 is pulled against rotating pulley 104 and turns plate 116. Plate 116 is frictionally engaged with flange 124 on hub 112, which is keyed to shaft 32 by means of key 126. Thus, shaft 32 is driven by pulley 104 when armature 100 is energized.

A significant problem in compressors of this type is the leakage of refrigerant through bearings 48 and out through the clutch mechanism 82. To prevent such leakage, there is provided a rotating seal comprising seal plate 128 having ground and lapped surface 130, carbon seal 132, and seal 134. Seal plate 122 is sealed against the pedestal 106 of crankcase 10 by means of seal 134 and is held in place by snap ring 136. Carbon seal 132, which rotates with shaft 32, is sealed with respect to shaft 32 by O-ring 138, and is tightly pressed against seal plate 128 by spring 140, the latter being held in place by retainer 142.

A problem with this type of seal, however, is that it generates considerable heat. To provide cooling and lubrication, the seal is enclosed within a sealed cavity 144, and a portion of the incoming refrigerant is introduced into cavity 144 through passageway 146. Passageway 146 connects with larger diameter passageway 148 in shaft 32, which in turn connects with suction chamber 78 through ports 150. Cylinders 24 behind pistons 26 connect with suction chamber 78 through ports 152 in crankshaft 32. By this arrangement, a portion of the refrigerant drawn into suction chamber 78 passes through passageway 148 in crankshaft 32, and a portion of this refrigerant flows into sealed chamber 144 through passageway 146. From chamber 144, the refrigerant flows back into cylinders 24 through bearings 48. This arrangement provides more efficient cooling than the prior art arrangement whereby the refrigerant is brought to the rotating seal by means other than a fluid passageway in the crankshaft.

In operation, with pulley 104 being driven by the belt system of the automobile, when coil 100 is energized, armature 118 is pulled into frictional engagement with pulley 104 thereby driving crankshaft 32. The rotating eccentric 140 causes yoke slide 30 to move in an orbital fashion so as to cause the piston-yoke elements 26 to reciprocate in their respective cylinders 24. On the downstrokes, refrigerant is drawn into suction chamber 78 and a portion thereof flows into cylinder 24 through ports 152, and the remainder flows into the larger diameter passageway 148 in crankshaft 32. A portion of this refrigerant flows into cylinders 24 through ports 154 and the remainder flows through passageway 146 into chamber 144 in order to cool the rotating seal. From chamber 144, the refrigerant flows through bearings 48 into cylinders 24. On the piston upstrokes, the pressurized refrigerant is forced past outlet valve 62 into chamber 80 and from there through discharge tube 86 to the airconditioning condenser (not shown).

As discussed above, the piston-yoke elements 26 are preassembled with their rings 46 to cylinder liners 22 and are inserted, together with crankshaft 32, bearings 34 and yoke slide 30 as a unit into crankcase half 14. The other half 12 of crankcase 10 is then placed over this assembly and secured to the first half 14 of crankcase 10 by means of screws 18. Following installation of the valve assemblies, cover 73 is secured in place.

An alternative arrangement for retaining clutch coil 100 is shown in FIG. 7 wherein coil bracket 156 is clamped between bearing 108 and pedestal 106. The front housing 76 is retained by a bevelled retaining ring 158 independently of the coil bracket 156. This allows the compressor to be assembled and tested without installing the clutch.

While this invention has been described as having a preferred design, it will be understood that it is capable of further modification. This application is, therefore, intended to cover any variations, user or adaptations of the invention following the general principles thereof and including such departures from the present disclosure as come within known or customary practice in the art to which this invention pertains and fall within the limits of the appended claims.

What is claimed is:

1. A radial compressor comprising:

a crankcase having at least three radially oriented cylinders therein, said crankcase comprising two halves in abutment along a planar interface axially intersecting said cylinders such that each of said cylinders is defined by a pair of semicylindrical recesses in the respective halves of said crankcase, a crankshaft received in said crankcase and positioned at the common center of said cylinders, a plurality of cylindrical pistons connected to said crankshaft so as to form therewith an interconnected assembly, said pistons being received in said cylinders, respectively, a cylindrical cylinder liner received in each of said cylinders and having said pistons received therein, said liners each having a cylindrical outer surface which is completely enclosed within said crankcase and which is contacted around substantially its entire periphery by the confronting surfaces of the respective pair of semicylindrical recesses, said liners serving to align the semicylindrical recesses of the respective pairs in a tangential direction relative to the axis of said crankshaft, and means for sealing one end of each of said liners.

2. The apparatus of claim 1 wherein the compressor is of the scotch yoke type having a yoke slide and a bearing between the slide and crankshaft, said bearing comprising a drawn cup needle bearing.

3. The compressor of claim 1 including a seal between said crankshaft and said crankcase, said seal being enclosed within a chamber, a suction inlet for said compressor, and a fluid passageway in said crankshaft in fluid communication with said inlet and leading to said chamber to provide cooling of said seal.

4. The compressor of claim 1 including: a valve mechanism associated with each of said cylinders located at the distal ends thereof, a sealed housing substantially completely enclosing said crankcase and in fluid communication with said cylinders through the respective valve mechanisms, and an external fluid conduit connected to said housing and in fluid communication with the interior thereof.

5. The compressor of claim 4 wherein said housing is formed in a plane transverse to the axis of rotation of said compressor.

6. The compressor of claim 5 including a second external fluid conduit connected to said housing and in fluid communication with the interior of said housing, said first conduit being a discharge line and said second conduit being a suction line for said compressor.

7. The compressor of claim 1 including an outer housing enclosing at least part of said crankcase and having an external suction line connected to one portion thereof and an external outlet line connected to the other portion thereof, and means for permitting refrigerant to pass from said one portion of said housing to said cylinders during the piston suction stroke and for permitting refrigerant to pass from said cylinders to the other portion of said housing on the piston power stroke, said portions of said housing being sealed from each other.

8. The compressor of claim 7 wherein said one portion of said housing defines a discharge chamber positioned radially outward of said cylinders, and the other portion of said housing defines a suction chamber.

9. A radial compressor comprising:

a crankcase having at least three radially oriented cylinders therein, said crankcase comprising two halves in abutment along a planar interface axially intersecting said cylinders such that each of said cylinders is defined by a pair of semicylindrical recesses in respective halves of said crankcase, a crankshaft received in said crankcase and positioned at the common center of said cylinders, a plurality of cylindrical pistons connected to said crankshaft so as to form therewith an interconnected assembly, said pistons being received in said cylinders, respectively, a cylindrical cylinder liner received in each of said cylinders and positioned radially between said pistons and said cylinders, said liners each having a cylindrical outer surface which is received in the respective pair of semicylindrical recesses and serves to align the semicylindrical recesses of the respective pairs in a tangential direction relative to the axis of said crankshaft, said crankcase substantially completely enclosing said liners and pistons, said pistons being received in said liners, a valve plate assembly on the distal end of each of said cylinders, and means for sealing one end of each of said liners comprising a flange on said liner clamped between the respective valve plate and said crankcase.

10. The compressor of claim 9 wherein said liners are steel and said pistons are aluminum.

11. A radial compressor comprising:

a crankcase having at least three radially oriented cylinders therein, said crankcase comprising two halves in abutment along a planar interface axially intersecting said cylinders such that each of said cylinders is defined by a pair of semicylindrical recesses in respective halves of said crankcase, a crankshaft received in said crankcase and positioned at the common center of said cylinders, a plurality of cylindrical pistons connected to said crankshaft so as to form therewith an interconnected assembly, said pistons being received in said cylinders, respectively, a cylindrical cylinder liner received in each of said cylinders and positioned radially between said pistons and said cylinders, said liners each having a cylindrical outer surface which is received in the respective pair of semicylindrical recesses and serves to align the semicylindrical recesses of the respective pairs in a tangential direction relative to the axis of said crankshaft, said crankcase substantially completely enclosing said liners and pistons, said pistons being received in said liners, means for sealing one end of each of said liners, and said compressor being of the scotch yoke type having a yoke slide and a bearing between said slide and crankshaft, said bearing comprising a plurality of needles retained within a cup.

12. The method of assembling a radial compressor having a plurality of radially oriented cylinders comprising:

providing first and second crankcase halves each having at least three radially oriented semicylindrical recesses therein, providing a plurality of cylindrical cylinder lines having cylindrical inner and outer surfaces, and inserting a piston in each of the liners, the pistons being slidably received therein and in a close interfitting relation with the inner surfaces of the liners, inserting the pistons and liners into respective semicylindrical recesses of the first crankcase half, connecting the pistons to a crankshaft so as to form an interconnected assembly, placing the second crankcase half on the first half with the semicylindrical surfaces of the second crankcase half overlying the cylinder liners, the outer cylindrical surfaces of the cylinder liners being completely enclosed within the crankcase and in contact with the confronting surfaces of the respective semicylindrical recesses around substantially the entire periphery of the liners so as to align the semicylindrical recesses of one crankcase half with the semicylindrical recesses of the other crankcase half in a tangential direction relative to the axis of the crankshaft, the crankshaft being generally at the common center of the cylinders, and securing the crankcase halves together.

13. The method of claim 13 including the subsequent step of enclosing the crankcase, crankshaft and piston assembly in an outer housing defining respective outlet and section chambers around the crankcase.

* * * * *

UNITED STATES PATENT OFFICE

CERTIFICATE OF CORRECTION

Patent No. 4,273,519 Dated June 16, 1981

Inventor(s) Edwin L. Gannaway

It is certified that error appears in the above-identified patent and that said Letters Patent are hereby corrected as shown below:

Col. 4, line 65, "user" should be -- uses --.

Claim 13, Col. 8, line 9, "13" should be -- 12 --.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*